US006003942A

United States Patent [19]

Haas

[11] Patent Number: 6,003,942

[45] Date of Patent: Dec. 21, 1999

[54] MECHANISM FOR RECLINING CHAIRS

[76] Inventor: Peter J. Haas, 95 Reef Rd., Fairfield, Conn. 06430

[21] Appl. No.: 09/173,526

[22] Filed: Oct. 15, 1998

Related U.S. Application Data

[62] Division of application No. 08/775,734, Dec. 30, 1996, Pat. No. 5,823,626.

[51] Int. Cl.[6] ..... A47C 1/032

[52] U.S. Cl. ..... 297/300.5; 297/300.2; 297/300.6

[58] Field of Search ..... 297/292, 300.2, 297/300.4, 300.8, 301.4, 300.5, 300.6, 300.7, 302.1, 302.3, 320, 303.1

[56] References Cited

U.S. PATENT DOCUMENTS

| | | | |
|---|---|---|---|
| 142,039 | 8/1873 | Niderkokn | 297/320 X |
| 689,942 | 12/1901 | Wright et al. . | |
| 717,026 | 12/1902 | Ostendorf . | |
| 1,271,636 | 7/1918 | Walton . | |
| 1,335,379 | 3/1920 | Lee . | |
| 3,072,436 | 1/1963 | Moore . | |
| 3,319,270 | 5/1967 | Greiner . | |
| 3,603,640 | 9/1971 | DOerner . | |
| 3,671,074 | 6/1972 | Bergstrom . | |
| 4,451,085 | 5/1984 | Franck et al. . | |
| 4,685,733 | 8/1987 | Machate et al. . | |
| 4,756,575 | 7/1988 | Dicks . | |
| 4,789,203 | 12/1988 | Van Zee et al. . | |
| 5,066,069 | 11/1991 | DeGelder . | |
| 5,108,148 | 4/1992 | Henke . | |
| 5,114,211 | 5/1992 | Desanta . | |
| 5,131,717 | 7/1992 | Kaminiski et al. . | |
| 5,249,839 | 10/1993 | Faiks et al. . | |
| 5,286,088 | 2/1994 | Taylor et al. . | |
| 5,333,368 | 8/1994 | Kriener et al. | 297/302.1 |
| 5,338,094 | 8/1994 | Perry . | |
| 5,383,712 | 1/1995 | Perry . | |
| 5,423,594 | 6/1995 | Hancock et al. . | |
| 5,584,533 | 12/1996 | Schrewe | 297/300.4 X |
| 5,649,740 | 7/1997 | Hodgdon | 297/303.1 |
| 5,725,276 | 3/1998 | Ginat | 297/301.4 X |
| 5,826,940 | 10/1998 | Hodgdon | 297/300.2 X |

FOREIGN PATENT DOCUMENTS

| | | |
|---|---|---|
| 521993 | 2/1956 | Canada . |

*Primary Examiner*—Peter R. Brown

[57] ABSTRACT

A reclining chair has a seat and a chair back both tiltably carried on a base. The chair back is provided with lever means for tilting the seat as the chair back is tilted. The lever means contacts the seat at a point which moves in response to the tilting of the chair back. Advantageously, the seat includes a contact portion, adapted for engagement with the lever means, which is configured to provide a predetermined displacement of the seat in response to displacement of the chair back.

8 Claims, 22 Drawing Sheets

MECHANISM FOR RECLINING CHAIRS

CROSS REFERENCE TO RELATED APPLICATION

The present application is a division of my application Ser. No. 08/775,734 filed Dec. 30, 1996 issued as U.S. Pat. No. 5,823,626 on Oct. 20, 1998.

BACKGROUND OF THE INVENTION

The present invention pertains to reclining chairs and, more particularly, to a chair wherein the seat and chair back recline in unison.

Reclining chairs are generally considered to be more comfortable than non-reclining seating, especially when one will be sitting for a lengthy period of time. For this reason, such chairs enjoy substantial popularity in both residential and public or commercial settings. Existing reclining chairs suffer however, in that they are often comparatively expensive, so as to make them unacceptable for use in a conference center or auditorium where a large seating capacity is required. In addition, the mechanisms of such chairs tend to be rather bulky, causing the chairs in which they are incorporated to be awkward, especially for people of short stature, and aesthetically unpleasing. This size problem is compounded by the inability to stack existing reclining chairs atop one another or to fold them for compact storage when the chairs are not in use. Finally, in most existing reclining chairs of the type wherein both the seat and the chair back recline, the tilting of the seat is excessive relative to the tilting of the chair back, whereby the chair is not ergonomically correct.

It is, therefore, a primary object of the present invention to provide a novel reclining chair which overcomes the shortcomings of the prior art. Specifically, it is a primary object to provide a reclining chair which is comparatively inexpensive and is ergonomically correct.

It is yet another object to provide such a chair wherein the reclining mechanism is compact, whereby the chair may be configured in such manner as to be comfortably usable by people of short statute and to be aesthetically pleasing.

SUMMARY OF THE INVENTION

It has now been found that the foregoing and related objects may be readily attained in an improved reclining chair having a seat and a chair back both tiltably carried on a base. The chair back is provided with lever means configured in length to provide a predetermined displacement for tilting the seat as the chair back is tilted. The lever means contacts the seat at a point which moves in response to the tilting of the chair back.

In accord with an aspect of the invention, the seat includes a contact portion, adapted for engagement with the lever means, which is configured to provide a predetermined displacement of the seat in response to displacement of the chair back.

Advantageously, the chair further comprises spring means biasing the seat and chair back to an upright or non-reclined position. The chair may be configured so as to be stackable or foldable.

DETAILED DESCRIPTION OF THE PREFERRED EMBODIMENTS

Figure 1:
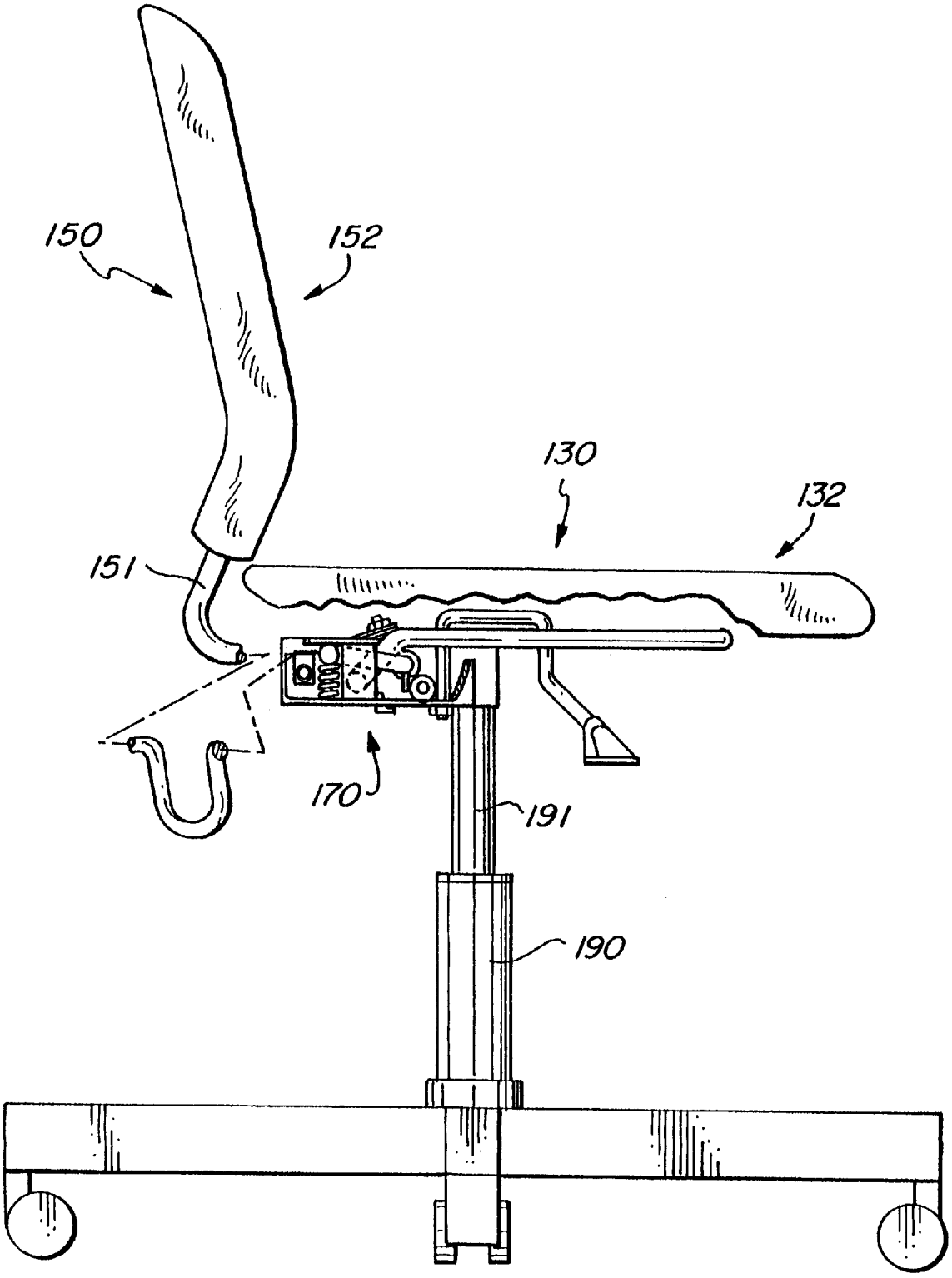
FIG. 1 is a side view of a reclining office chair in accord with the invention, in the upright position.
Figure 2:
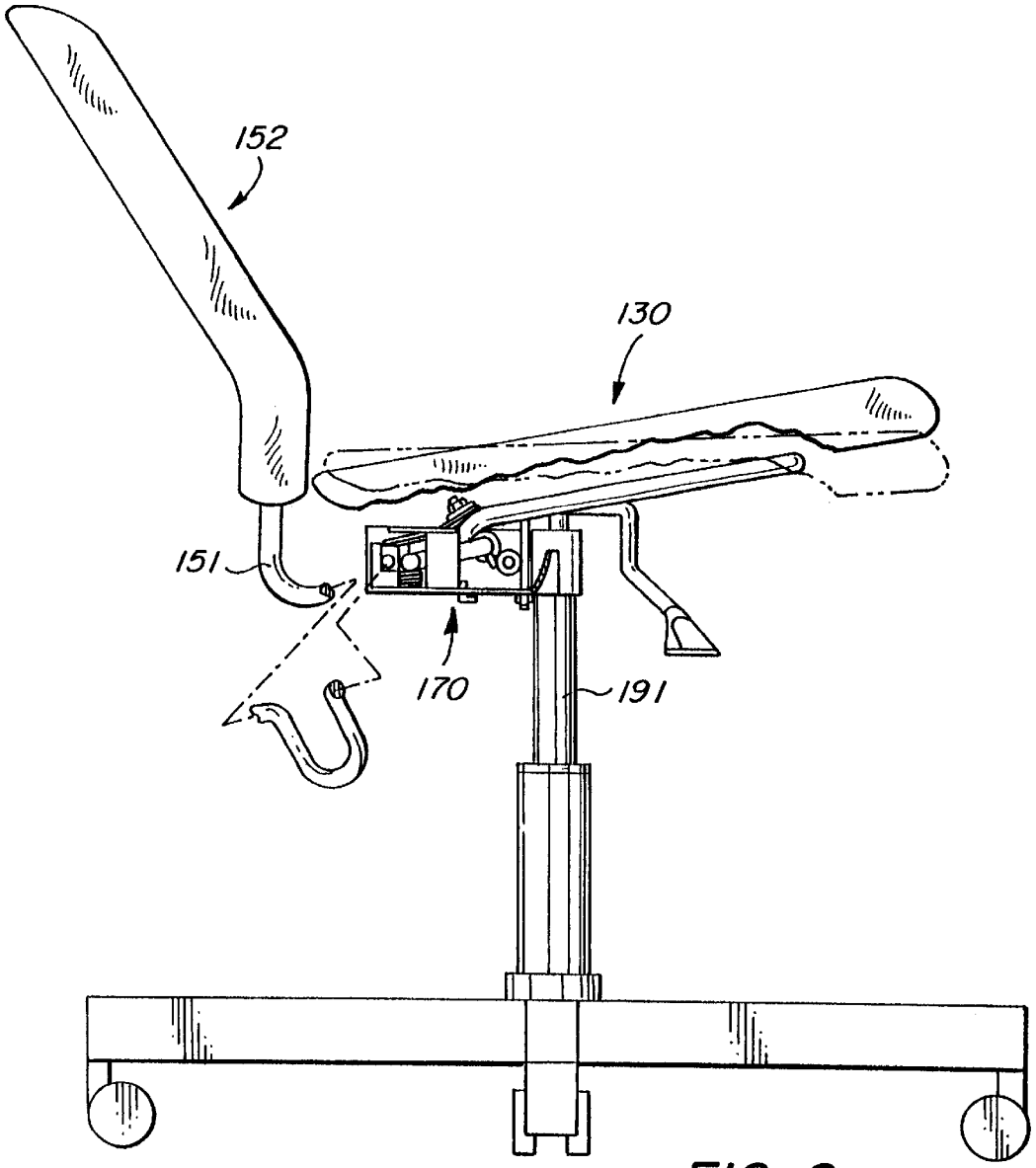
FIG. 2 is a side view of the chair of FIG. 1, in the reclined position.
Figure 3:
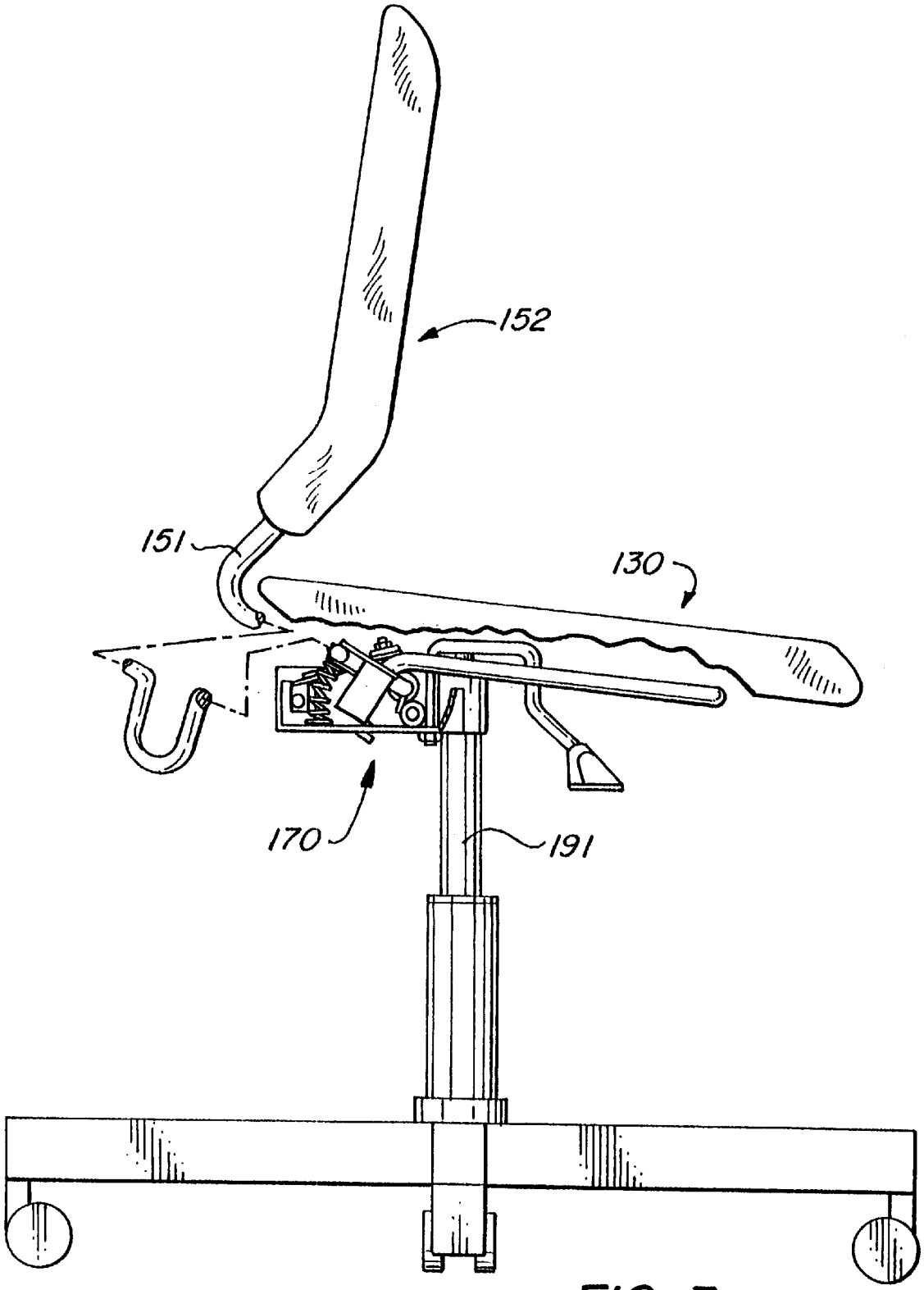
FIG. 3 is a side view of the base of the chair of FIGS. 1 and 2 in the task position.

Turning now to FIGS. 1–3, there is seen a reclining chair comprising a seat 130 and a chair back 150 both tiltably carried on a base 170 which is pivotally mounted on a pedestal 190.

Figure 4:
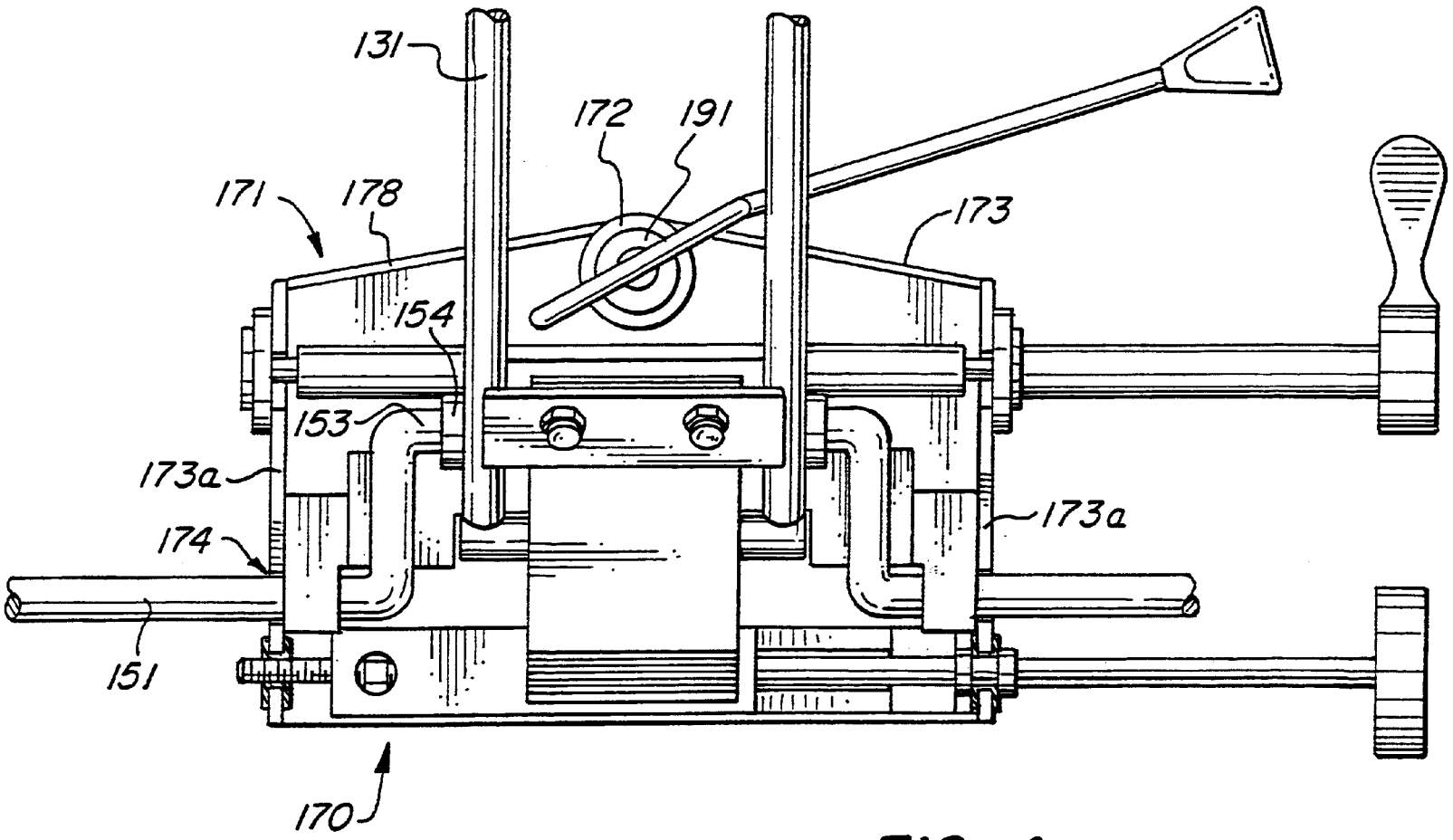
FIG. 4 is a top view of the base of the chair of FIGS. 1–3.
Figure 5:
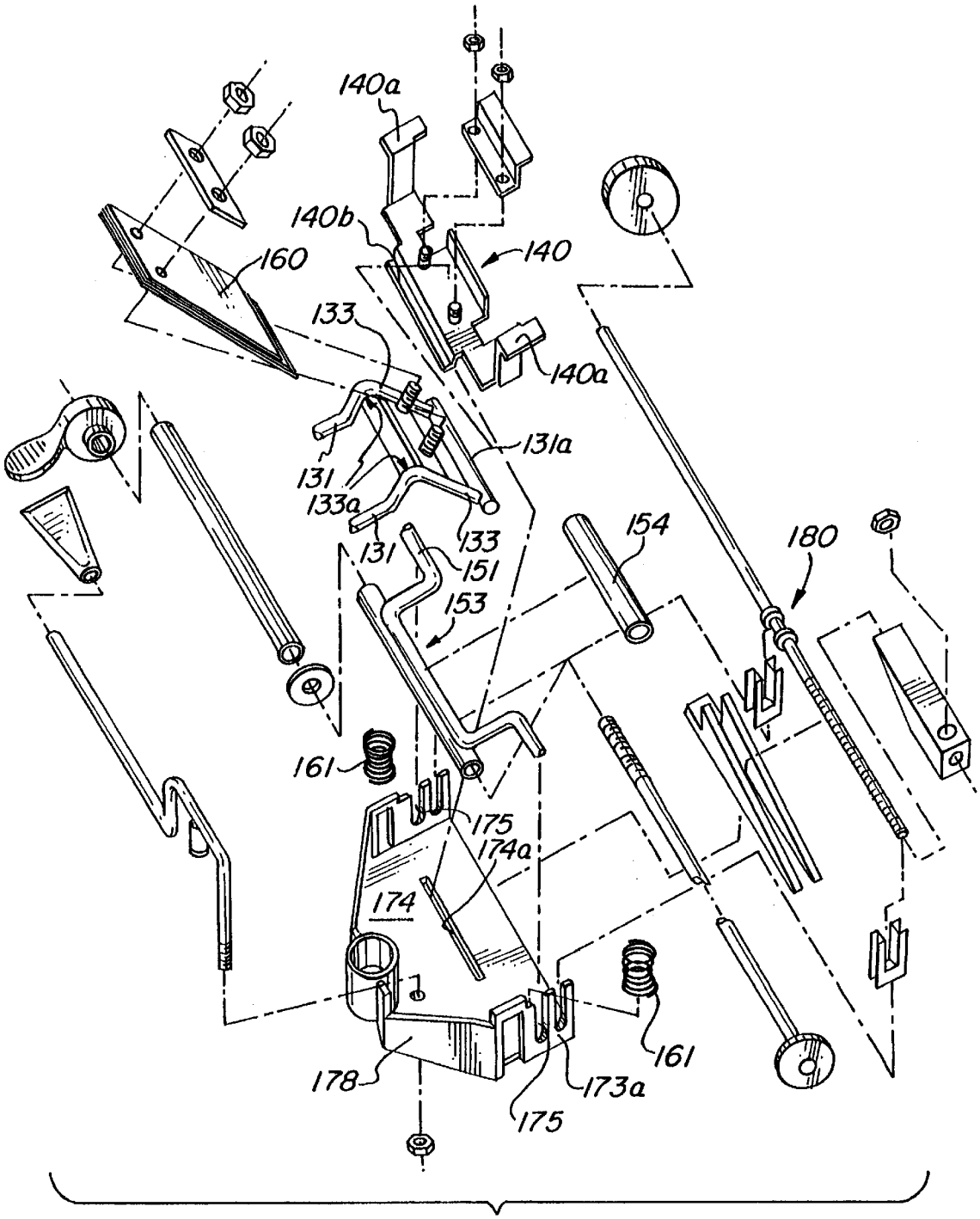
FIG. 5 is an exploded view of the chair base of FIGS. 1–4.

The mechanism which controls the tilting of seat 130 and chair back 150 and governs the relation therebetween, is disposed in base 170 and is best seen in FIGS. 4–5*a*.

Base 170 includes a generally U-shaped mechanism cradle 171 having a planar cradle base 174 and a central cylindrical hub 172 which rotatably receives an upstanding shaft 191 of pedestal 190. Extending from hub 172 are cradle wings 173 which terminate in substantially parallel end portions 173*a*.

A chair back frame 151, tiltably carried in vertical notches 175 in cradle wings 173*a*, supports a chair back cushion 152. Chair back frame 151, which is advantageously formed from half inch diameter steel rod, includes an offset portion comprising a lever 153 preferably bearing a rotatable plastic back frame bushing 154.

A seat frame 131, hingedly secured to cradle base 174 by frame hold down assembly 140, supports seat cushion 132. Seat frame 131, which is also advantageously formed from steel rod, is rotatable about its frame base 131*a*. The portions of seat frame 131 extending from and adjacent to base 131*a* comprise seat contact members 133 which overlie lever 153 and bushing 154.

As chair back 150 is tilted back, it rotates in notches 175 and lever 153 is forced upwardly against seat contact members 133, causing seat 130 to rotate about frame base 131*a*. As both chair back 150 and seat 130 tilt back, the point of contact between lever 153 and contact members 133 moves away from the pivot point of the seat. Thus, as chair back 150 tilts further, an ever increasing effort is required to continue the tilting. This level of effort to effect continued or further tilting may be controlled or tailored by configuring contact members 133 and/or adjusting the length of lever 153 to provide a predetermined displacement of seat 130 in response to displacement of chair back 150. Such a configuration is best illustrated in FIG. 5, where it is seen that contact members 133 include portions 133*a*, somewhat remote from frame base 131*a*, which are turned rather sharply away from seat 130. When lever 153 reaches remote portions 133*a* of contact members 133, the force or effort required for further tilting of chair back 150 diminishes while the relative motion of seat 130 and chair back 150 changes. It will be appreciated that the level of effort required, and the relative displacement of seat 130 and chair back 150, is proportional to the angle of the contact member remote portions 133*a* and the length of lever 153.

A leaf spring 160 fixed to seat frame 131 biases it downwardly to its horizontal or non-reclined position. This urges lever 153 downwardly, thereby also biasing chair back 150 into its upright or non-reclined position. Preferably, a pair of coil springs 161 are disposed adjacent notches 175 and bear against chair back frame 151. Chair back frame 151 is captured in notches 175 by flanking portions 140*a* of frame hold down 140.

As chair back 150 is tilted back, it initially moves vertically downward in notches 175, compressing coil springs 161 such that the position of seat 130 is largely unaffected. Thus, chair back 150 may be reclined without titling of seat 130 and, therefore, without lifting the legs of the user. This is considered ergonomically correct. Many existing tilting chairs are ergonomically incorrect in this regard. As chair back 150 continues to tilt back, the resistance of coil springs 161 increases, causing greater rotation of chair back frame 151 in notches 175 and less vertical movement. As lever 153 begins to rotate upwardly, it causes seat 130 to tilt back. However, as chair back 150 tilts further and further back, the point of application of force to seat 130 moves further and further from the pivot point and the amount of force necessary to accomplish the tilting increases. When lever 153 reaches the sharply inclined remote portions 133*a* of contact member 133, however, further tilting becomes easier. When seat 130 and chair back 150 are in their fully reclined position, it is possible to return seat 130 to its upright or horizontal position without also moving chair back 150, as shown in dotted lines in FIG. 2. This may be accomplished by the user relaxing his or her legs. The increased leverage thus created forces the last bit of downward travel of coil springs 161, dropping lever 153 lower and relieving the upward force on contact members 133, thereby bringing seat 130 to its horizontal position. This feature of the chair to move seat 130 to its horizontal position during quick body movements, is ergonomically superior as it relieves the upward force on the user's legs. The present mechanism provides the capability of passing from the task position to the fully reclined position in a single fluid motion.

Figure 6:
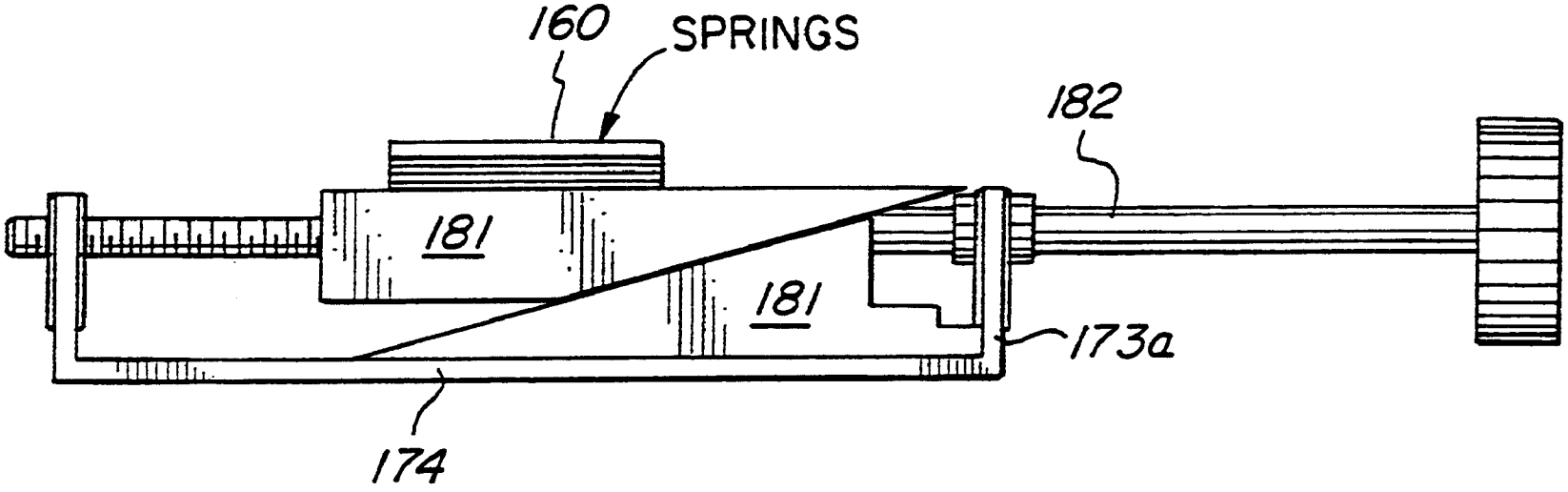
FIG. 6 is an end view of the chair base of FIG. 5.

The level of force required to achieve any degree of reclining of the chair may be adjusted by the chair user through use of a spring tension control 180. As best seen in FIG. 6, spring tension control 180 includes a pair of opposed wedges 181, underlying leaf spring 160, which may be drawn together or moved apart by a threaded rod 182. As wedges 181 are drawn together, their combined height increases thereby increasing the spring force on seat frame 131 and increasing the force required to recline the chair. Moving wedges 181 apart reduces the required force. This control provides desired adjustability while maintaining a low profile for the tilting mechanism.

Advantageously, frame hold down assembly 140 includes a downwardly stepped flange 140*b* which is hingedly carried in a transverse slot 174*a* in cradle base 174. This arrangement allows the chair user to tilt seat 130 forwardly to the task position which is illustrated in FIG. 3. As seat 130 tilts forwardly, sliding forward over plastic bushing 154, chair back 150 follows due to the upward force of coil springs 161 against chair back frame 151. Frame hold down 140 tilts forward about its flange 140*b*, allowing chair back frame 151 to move vertically upward in notches 175. As the chair moves to the task position, chair back 150 tilts many more degrees forward than does seat 130.

Figure 7:
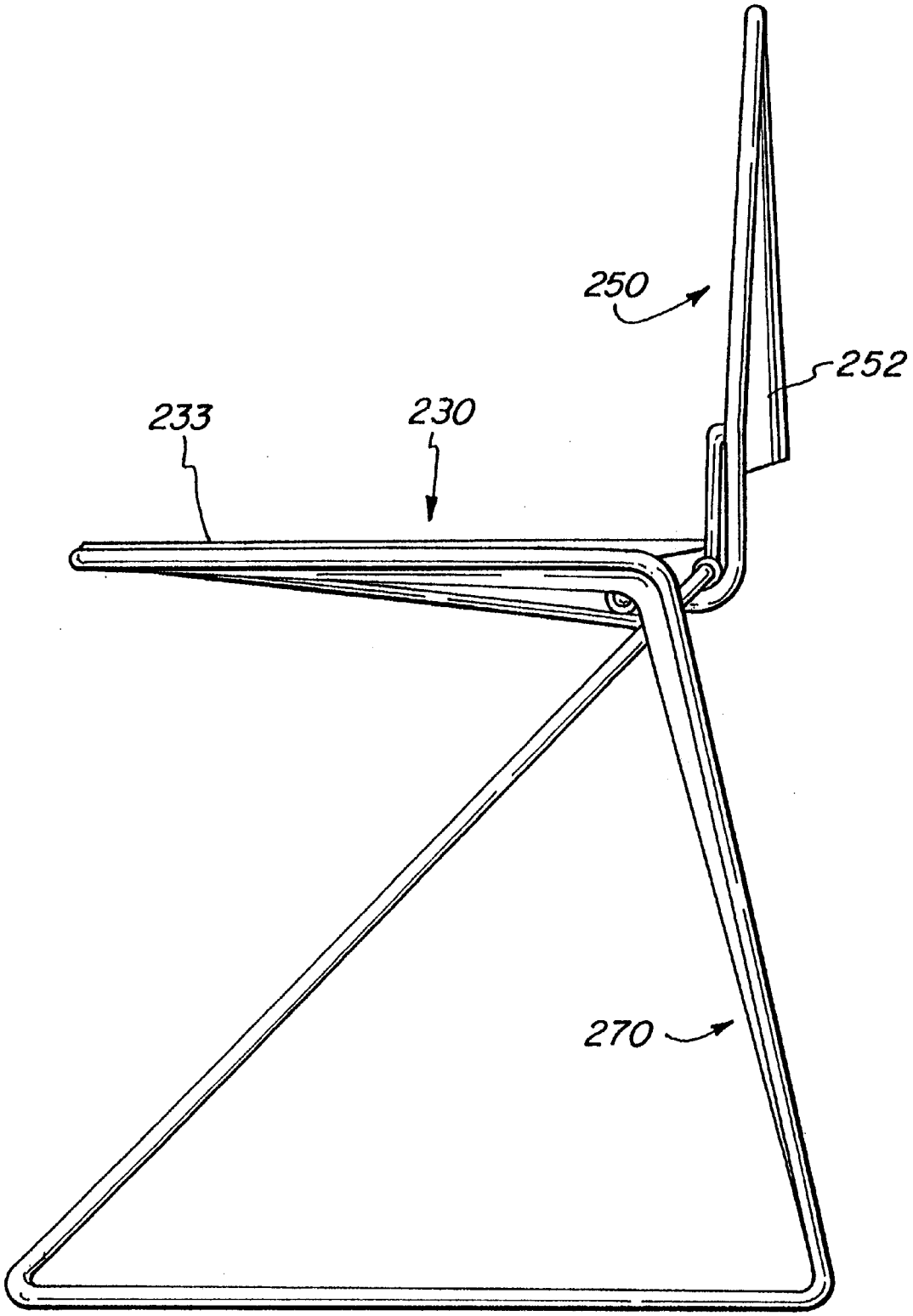
FIG. 7 is a side view of a stackable reclining chair in accord with the present invention, in the upright position.
Figure 8:
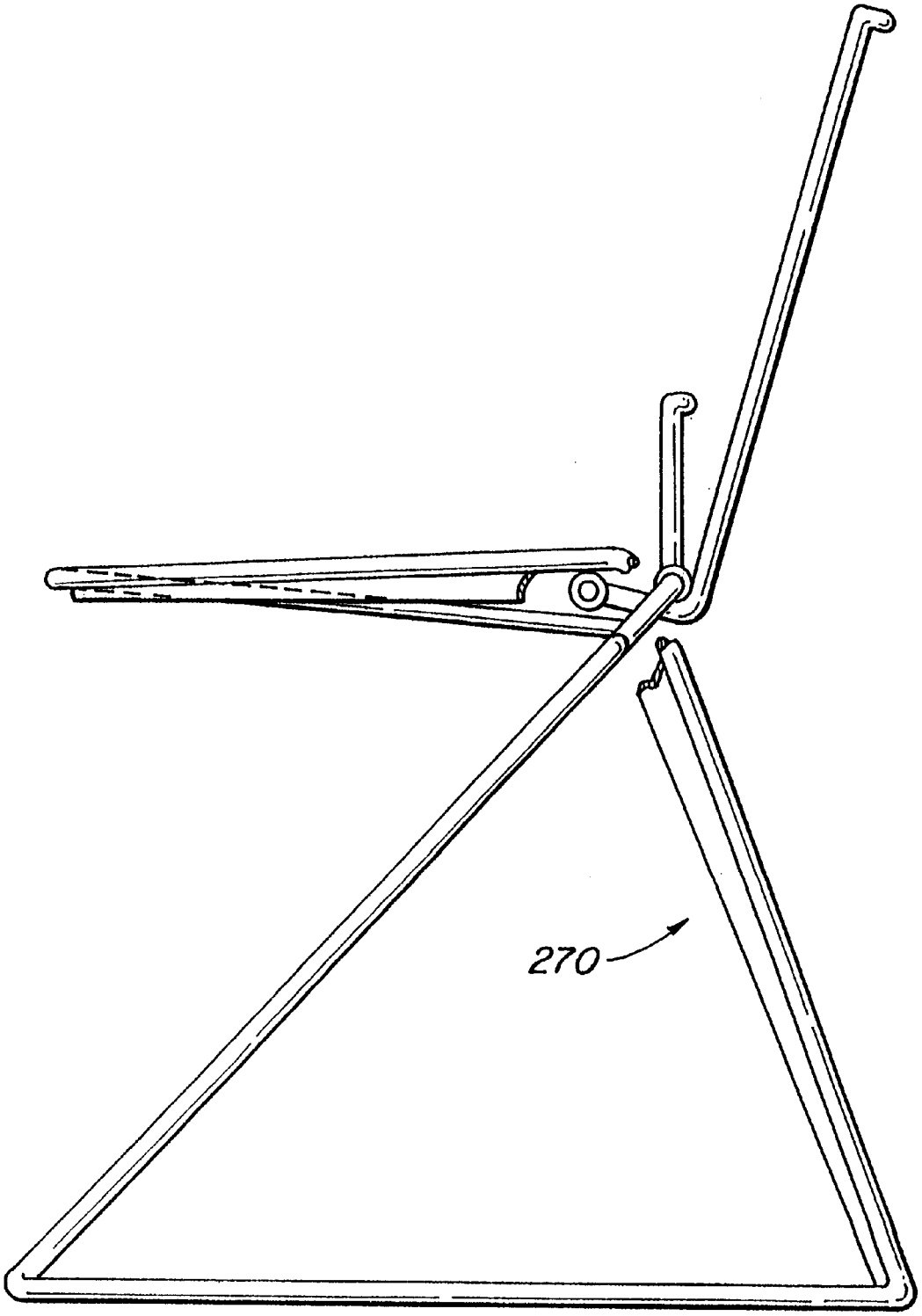
FIG. 8 is a side view of the chair of FIG. 7 in the reclined position.
Figure 9:
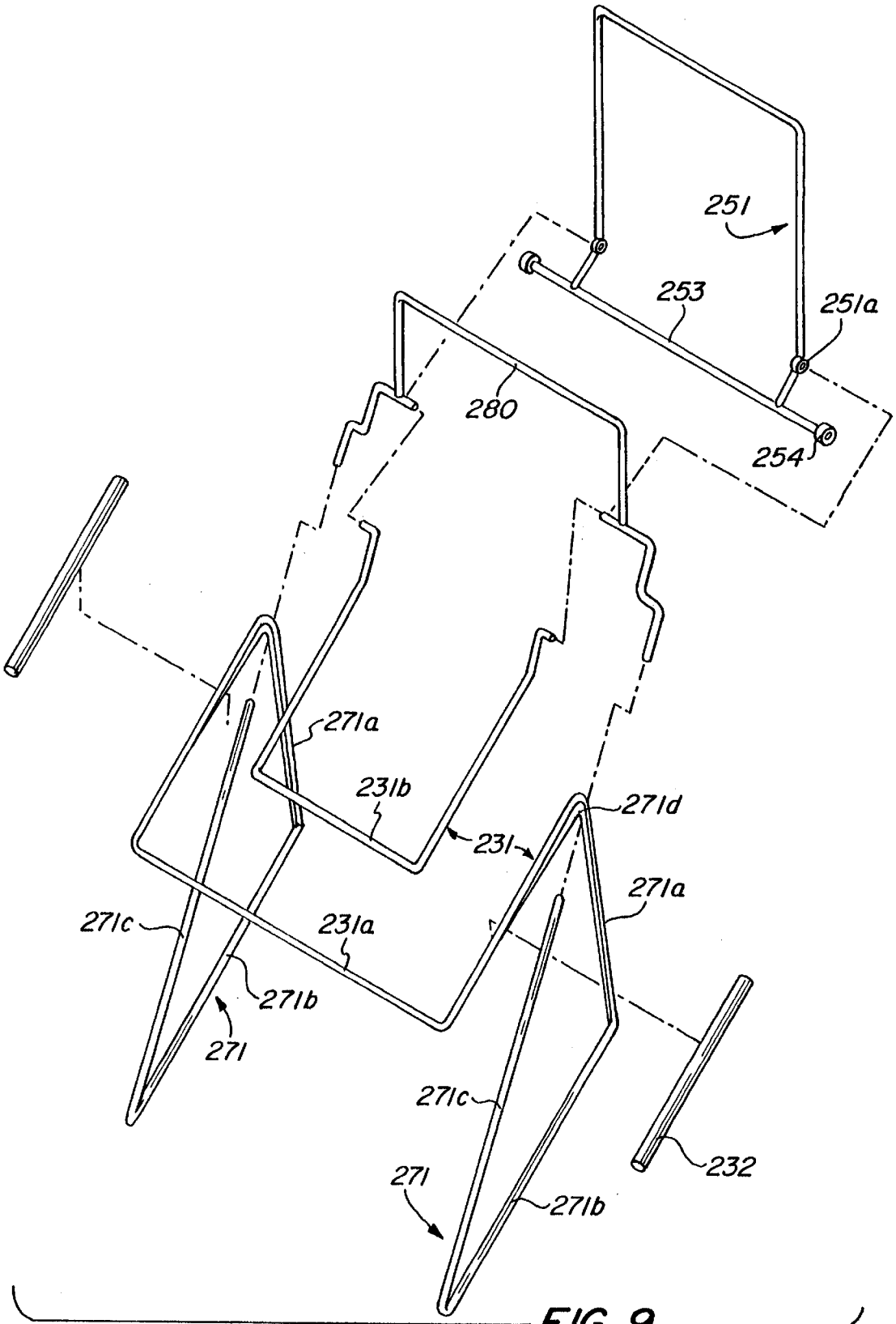
FIG. 9 is an exploded view of the chair of FIG. 7, with the cushions removed.

Turning next to FIGS. 7–9, there is seen a stackable reclining chair comprising a seat 230 and a chair back 250 both tiltably carried on a base 270.

As best seen in FIG. 9, base 270 comprises a pair of substantially parallel, generally triangular base sides 271 which support a cantilevered seat frame 231, to which is fastened seat cushion 233. Base sides 271 each include a generally vertical back leg 271*a*, a generally horizontal bottom leg 371*b*, which is intended to rest on the floor, and an inclined front leg 371*c*. Base 270 and seat frame 231 are formed of a single continuous piece of half-inch diameter steel rod.

Seat frame 231 includes generally U-shaped upper and lower seat frame members 231*a* and 231*b* respectively. Upper seat frame member 231*a* is a continuation of, and communicates between back legs 271*a*. Suitable frame reinforcements 371*d* are provided at the junctures of upper seat frame member 231*a* and back legs 271*a* to prevent bending. Lower seat frame member 231*b* is a continuation of, and communicates between front legs 271*c*. Lower seat frame member 231*b* is positioned within and slightly below upper seat frame member 231*a*. The front sides of both seat frame members are welded together. Seat 230 is tiltable, relative to floor legs 271*b*, with the unreinforced junctures between seat frame 231 and the supporting members acting as torsional springs.

A chair back frame 251, pivotally carried on base 270 supports a chair back cushion 252. Chair back frame 251 which is also formed of steel rod, includes a lever 253 projecting substantially perpendicularly from chair back frame 251, at the pivot connection 251*a* with base 270. The projecting ends of lever 253 are provided with rotatable plastic back frame bushings 254.

Lever 253 extends between upper seat frame member 231*a* and lower seat frame member 231*b*, with bushings 254 contacting the lower surfaces of elliptical tubes 232 welded along the undersides of both sidewalls of upper seat frame member 231*a*. As chair back 250 is tilted back, it initially moves vertically downward, twisting or bending front legs 271*c* about their juncture with floor legs 271*b*, such that very little rotation of chair back frame 251 occurs and the position of seat 230 is largely unaffected. As chair back 250 continues to tilt back, the torsional resistance of the supporting members increases, causing greater rotation of chair back frame 251 about pivot connection 251*a* and less vertical movement. As lever 253 begins to rotate upwardly, it causes seat 230 to tilt back. However, as chair back 250 tilts further and further back, the point of application of force to seat 230 moves further and further from pivot point 251*a* and the amount of force necessary to accomplish the tilting increases. By appropriate selection of the configuration of elliptical tubes 232, and the length of lever 253, the relative motion of seat 230 and chair back 250 may be adjusted or controlled.

A transverse lumbar kick bar 280 is attached to base 270 adjacent pivot connection 251*a* of chair back frame 251. Lumbar kick bar 280 is closely adjacent chair back 250 when the latter is in its upright, unreclined position. As chair back 250 tilts back, lumbar kick bar 280 remains substantially fixed in position, providing lower back support to the chair user.

It is to be noted that seat 230 is biased, by the torsional springs of the supporting elements, to its unreclined position and, in turn, biases chair back 250 to its unreclined position.

Figure 10:
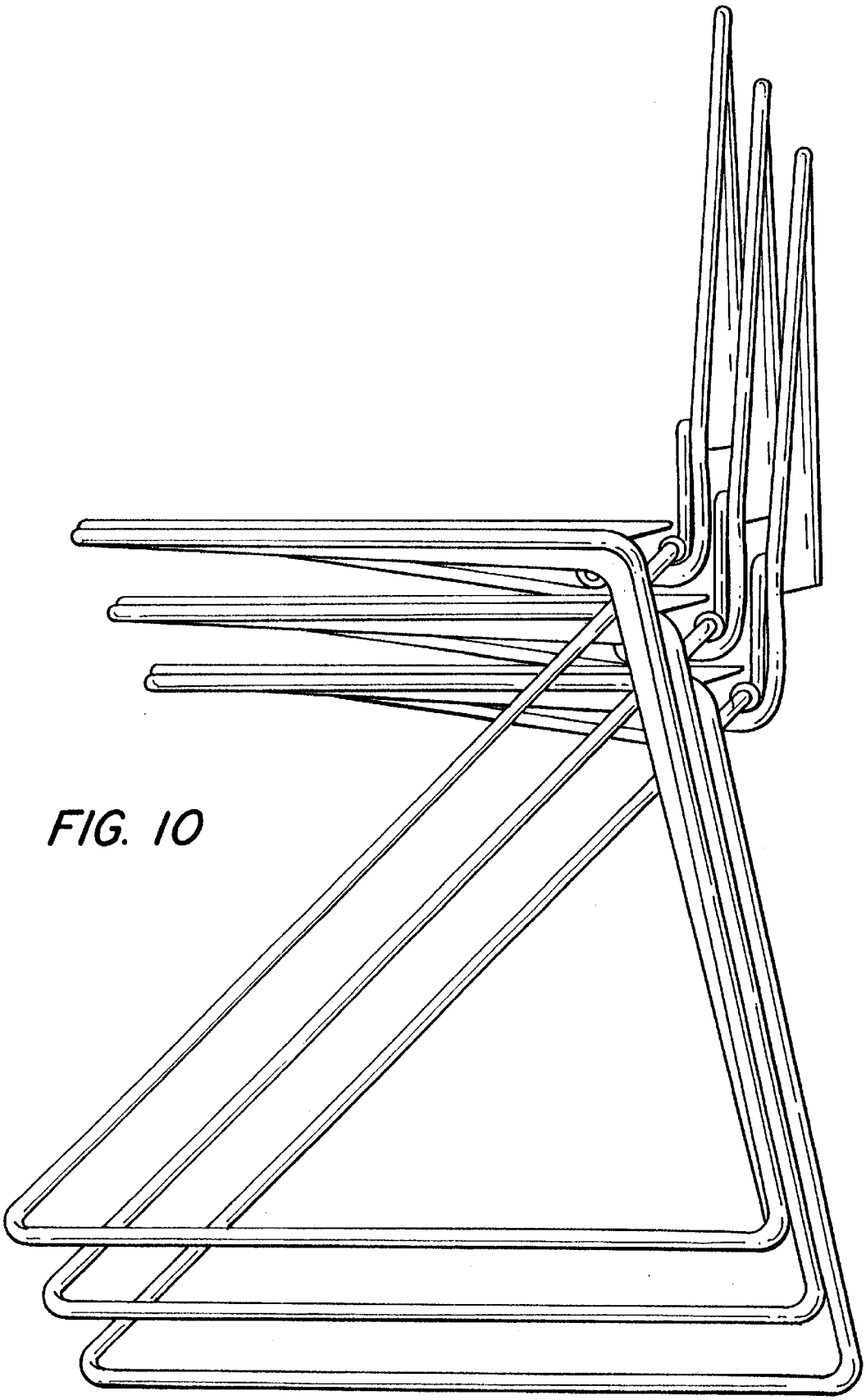
FIG. 10 is a side view of several of the chairs of FIGS. 7–9 arranged in a vertical stack.

As illustrated in FIG. 10, a number of the present chairs may be vertically stacked to provide for compact storage.

Figure 11:
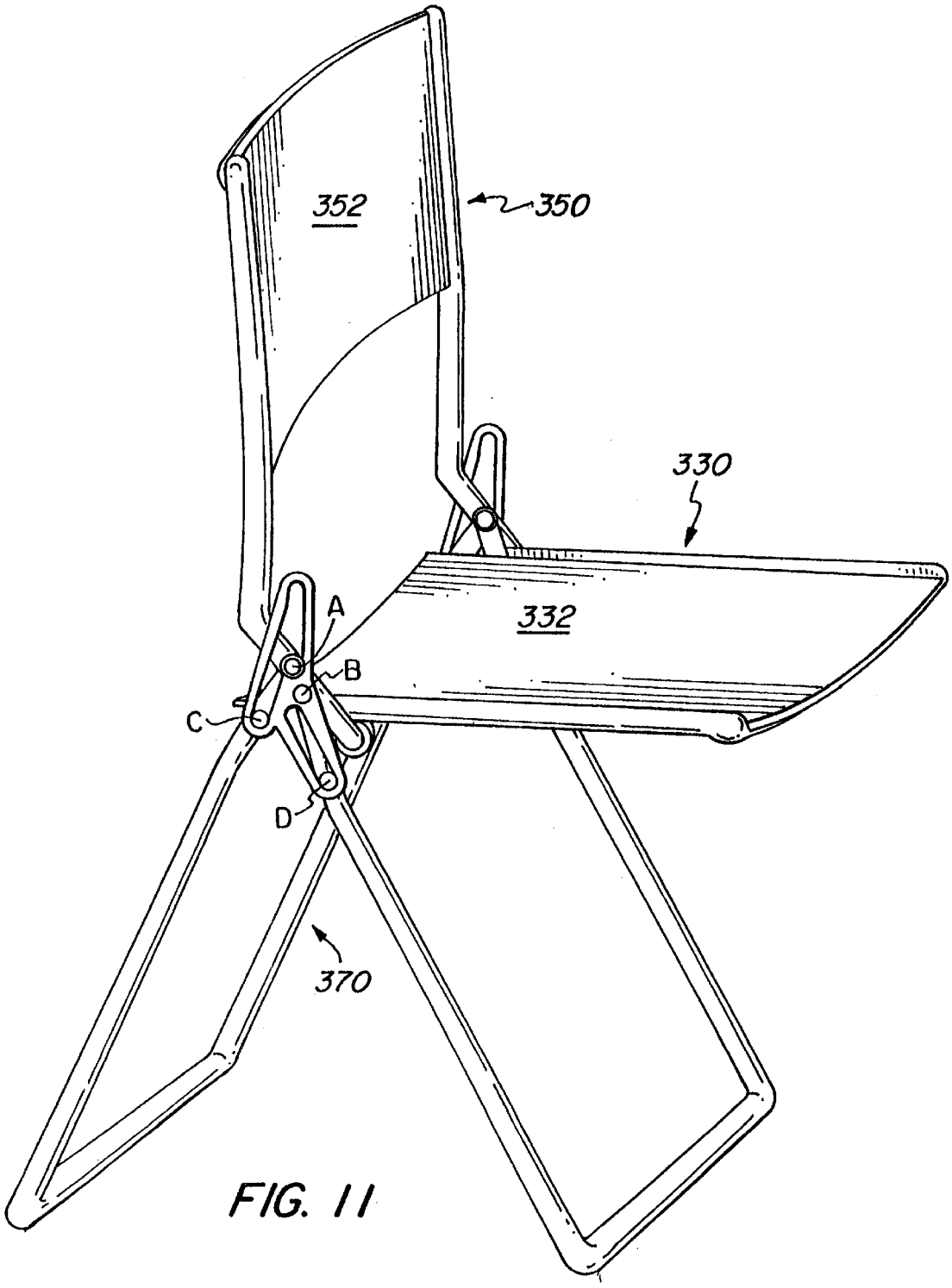
FIG. 11 is an isometric view of a reclining folding chair in accord with the present invention, in the unfolded and upright position.
Figure 12:
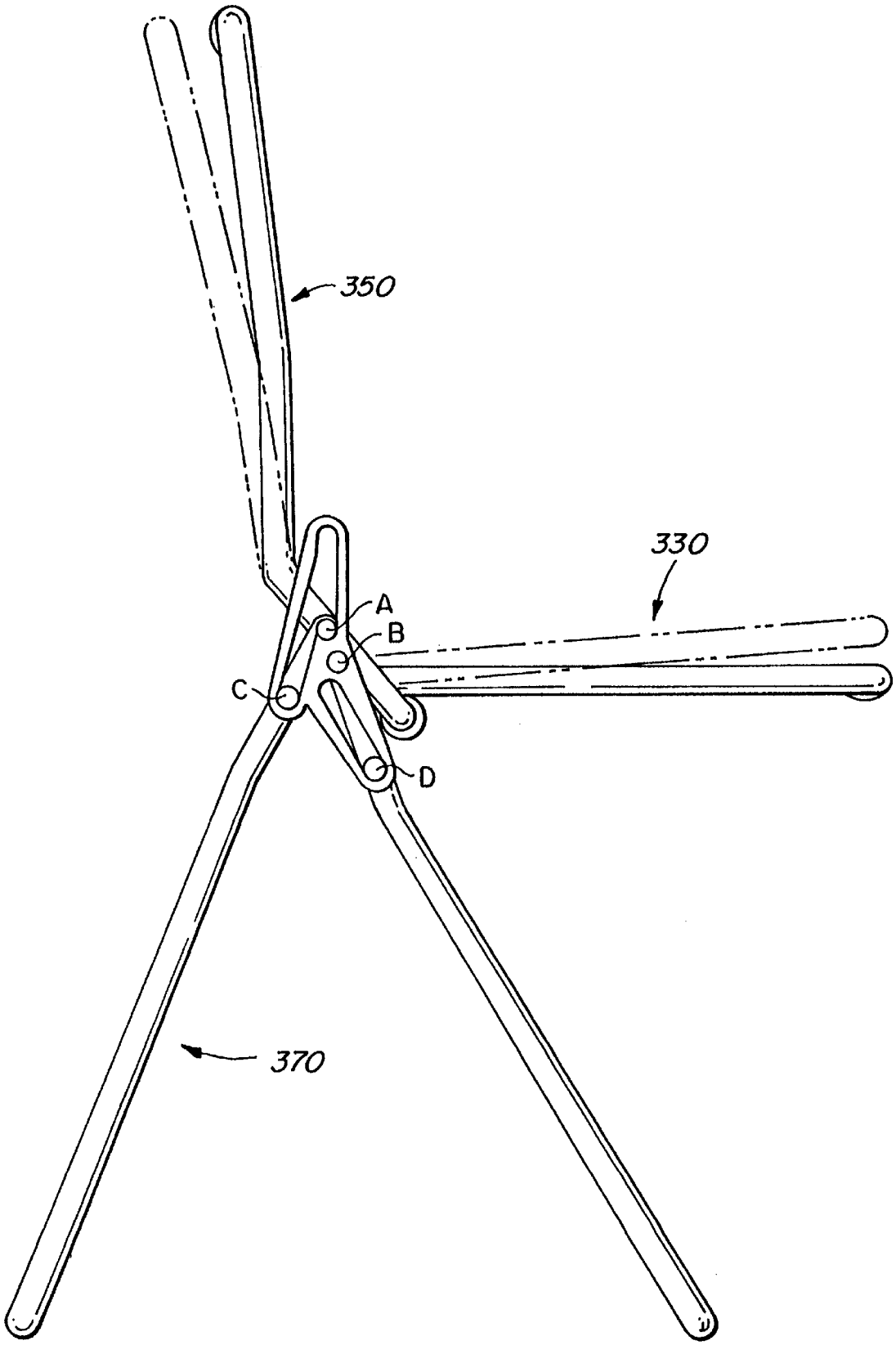
FIG. 12 is a side view of the chair of FIG. 11 in the upright position.
Figure 13:
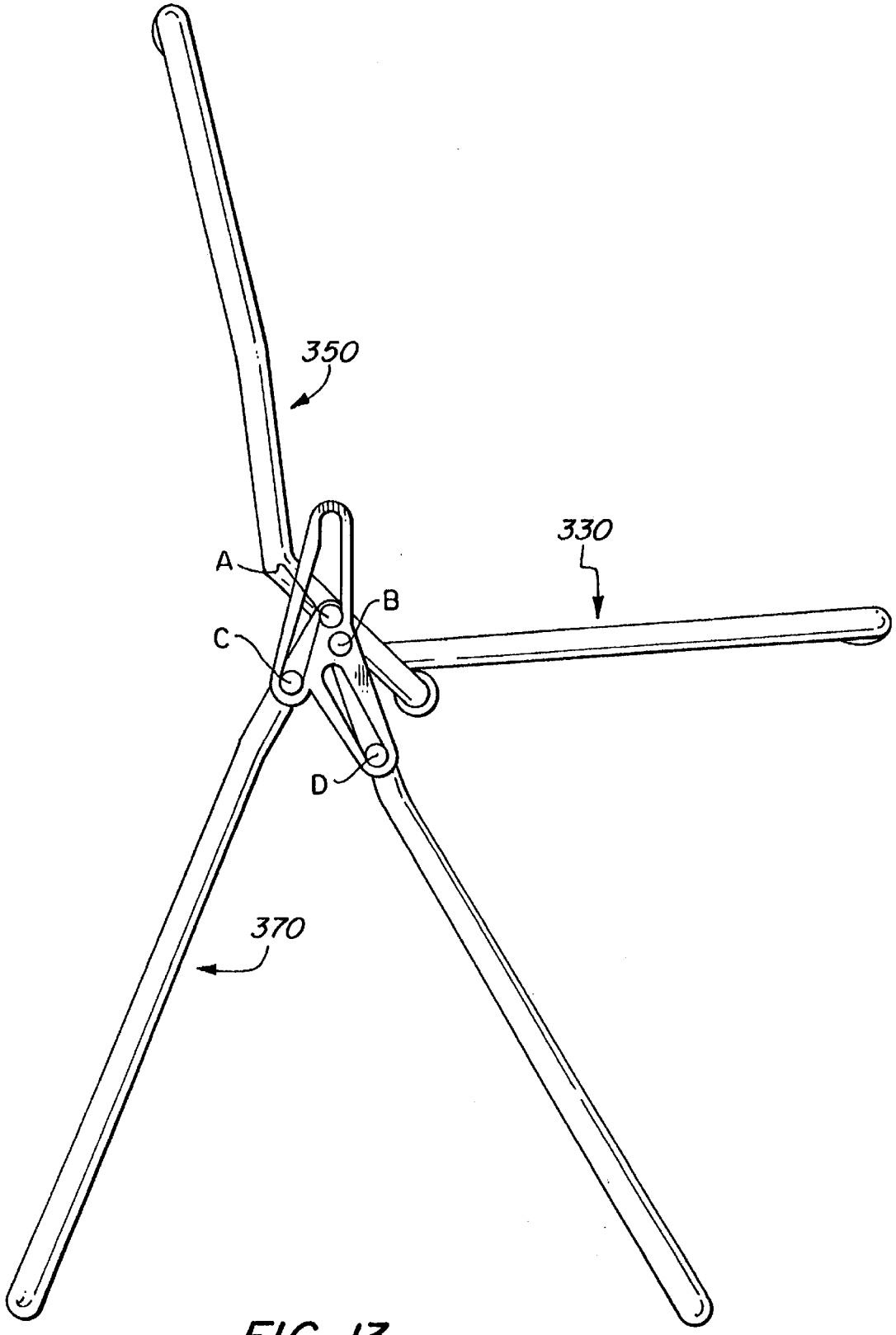
FIG. 13 is a side view of the chair of FIG. 11 in the reclined position.
Figure 14:
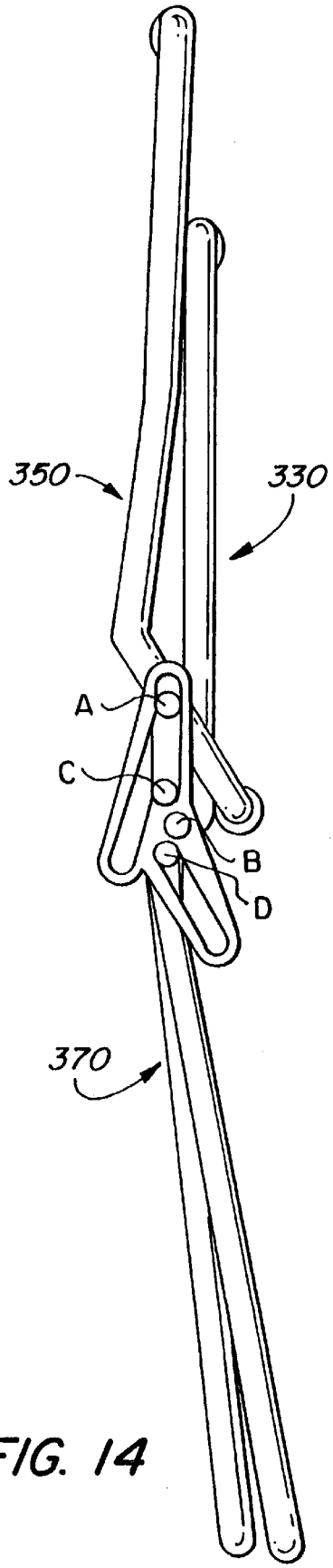
FIG. 14 is a side view of the chair of FIG. 11 in the folded position.

Turning now to FIG. 11, there is seen a folding reclining chair comprising a seat 330 and a chair back 350 both tiltably carried on a base 370.

Figure 15:
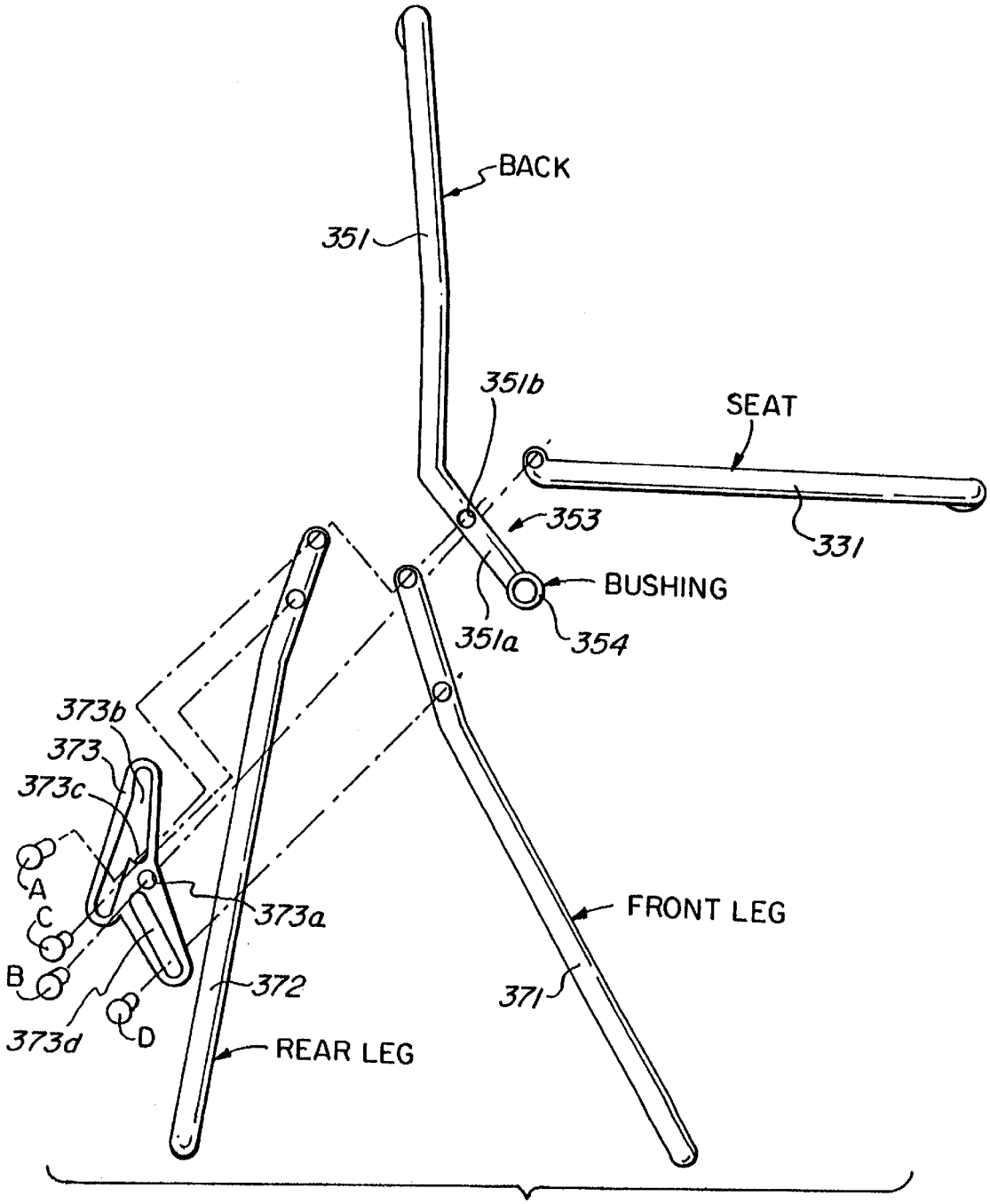
FIG. 15 is an exploded view of the chair of FIGS. 11–14.

As best seen in FIG. 15, base 370 comprises a generally U-shaped front leg member 371 pivotally connected to a generally U-shaped back leg member 372 by a pair of pins A. A pair of cam plates 373 are disposed outward of leg members 371 and 372.

A generally U-shaped seat frame 331, pivotally carried on base 370 by pins B passing through mating holes 373*a* in cam plates 373, supports a seat cushion 332.

A generally U-shaped chair back frame 351, is pivotally connected to base 370 by pins A, supports a chair back cushion 352. The frame members of the folding chair are formed of ¾ inch diameter steel tube. The legs 351*a* of chair back frame 351 project beyond the pivot connection 351*b* with base 370 and comprise a lever 353. Advantageously, the distal ends of lever 353 are provided with rotatable plastic back frame bushings 354. When the chair is in its unfolded position, seat frame 331 rests on bushings 354 of lever 353.

Pins C secured to the upper ends of back leg members 372 below pins A pass through generally vertical cam slots 373*b* in cam plates 373. When the chair is in its unfolded or use position, pins C rest in the bottom most position of cam slots 373*b*. Similarly, pins D secured to the upper ends of front leg member 371 below pins A pass through a second, rearwardly inclined cam slot 373*d*. When the chair is initially occupied, the weight of the occupant is effectively concentrated in the middle of seat 330, outward of lever 353, imparting a downward force, which pivots seat 330 about lever 353 and bushings 354. An upward force is thus imposed on pins B which connect seat frame 331 to base 370. As the seat occupant leans back however, chair back 350 tilts rearwardly, pivoting about pins A, and lever 353 presses upwardly on seat frame 331 causing it to tilt or rotate. As chair back 350 tilts further and further, the point of contact between lever 353 and seat frame 331 advances away from pins B, thereby reducing the force needed to further recline the chair. The extent to which the chair may be reclined is controlled by the position of holes 373*a* and the length of lever 353. Cover plates (not shown) may be provided over cam plates 373 for both safety and aesthetic reasons.

Figure 16:
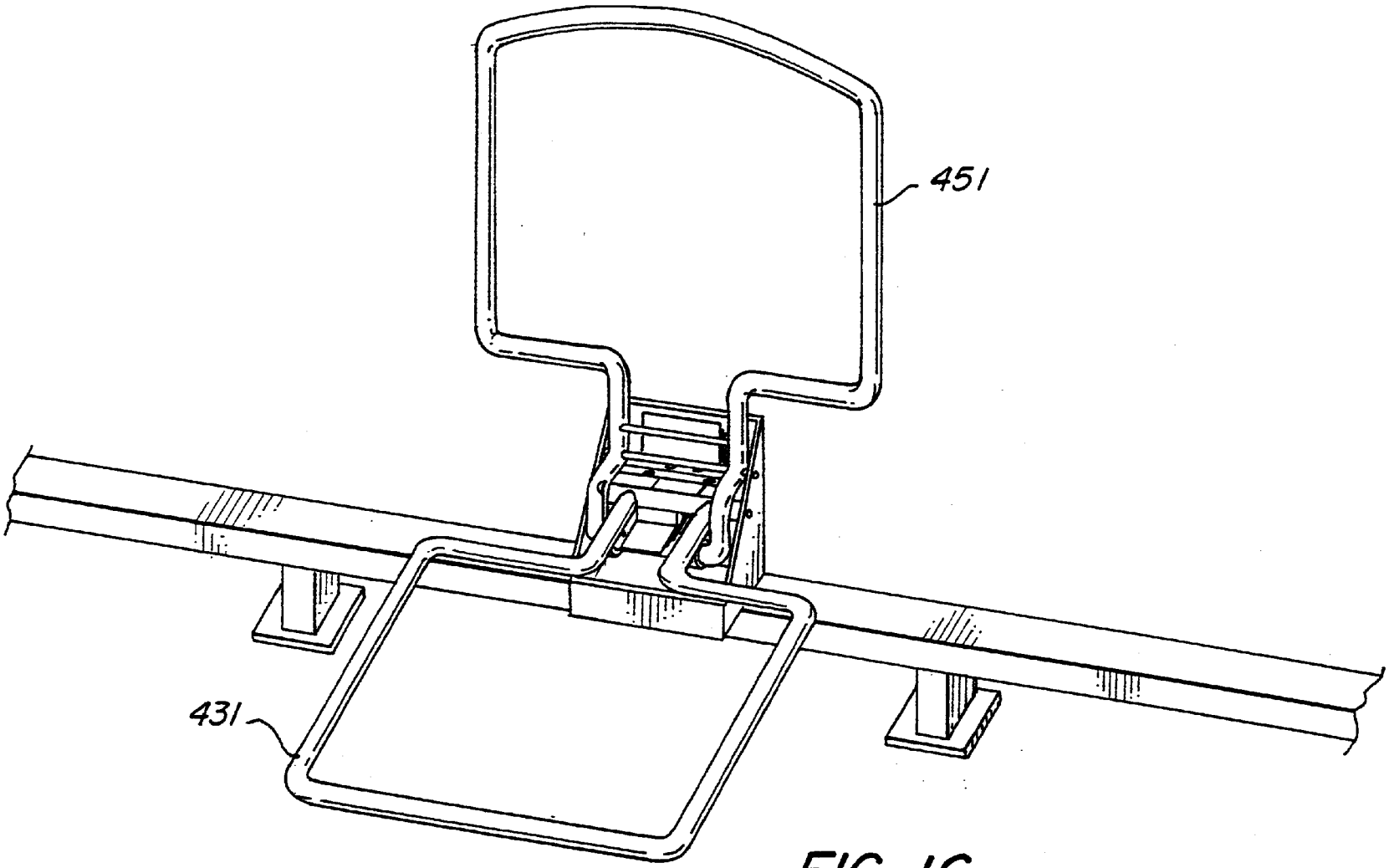
FIG. 16 is an isometric view of a reclining theater chair in accord with the present invention, in the unfolded and upright position.
Figure 17:
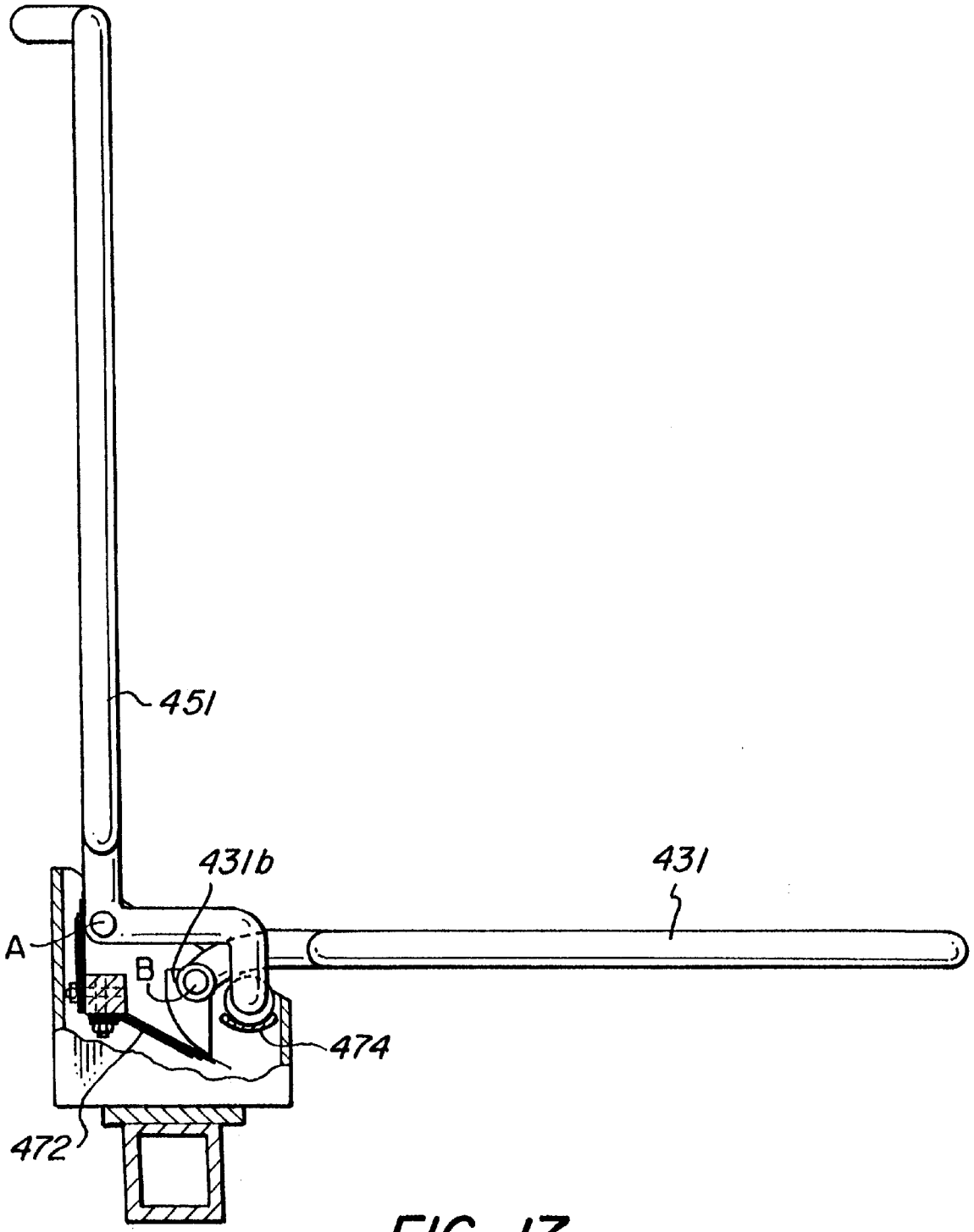
FIG. 17 is a side view, partly broken away, of the chair of FIG. 16 in the unfolded and upright position.
Figure 18:
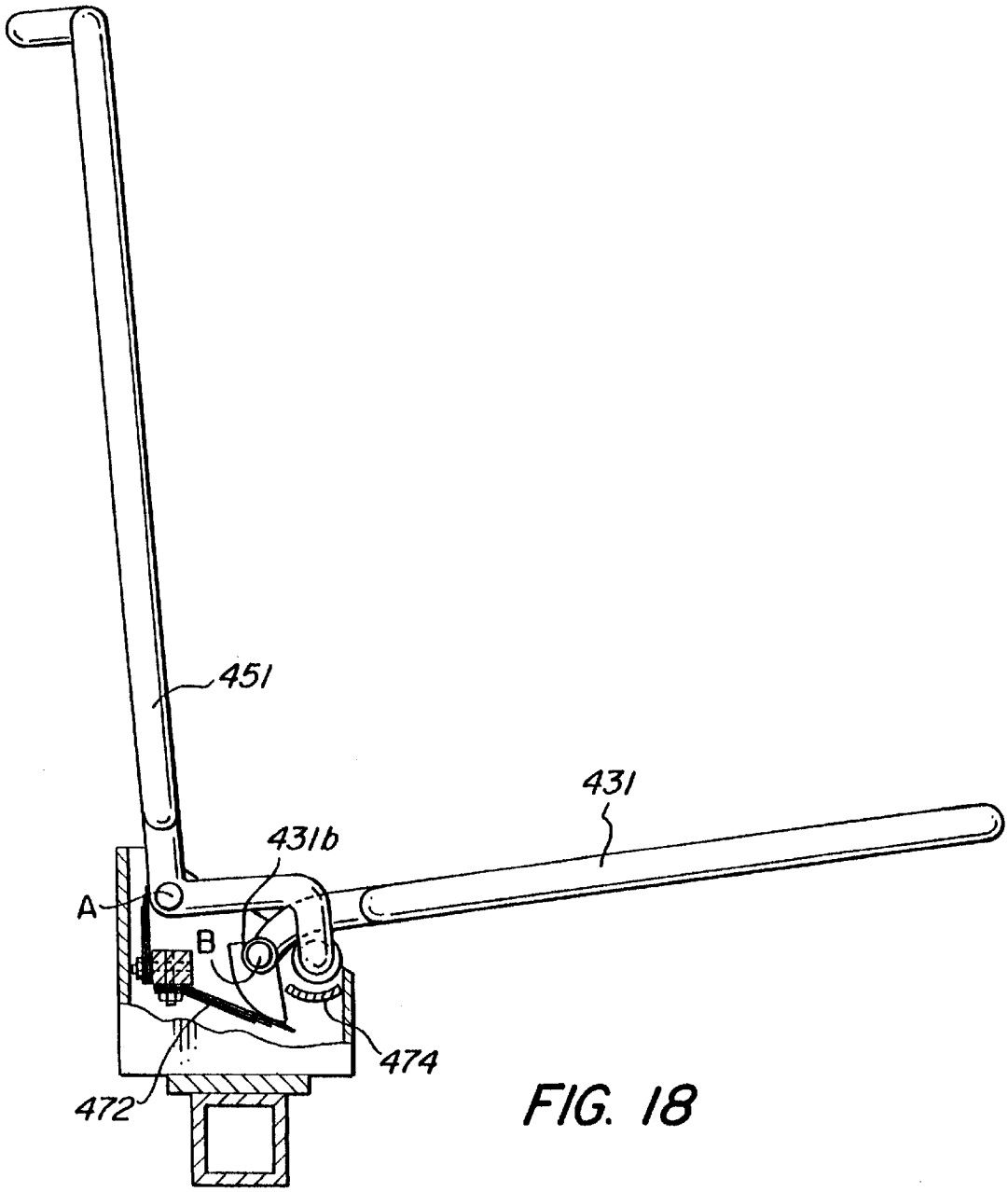
FIG. 18 is a side view, partly broken away, of the chair of FIG. 16 in the unfolded and reclined position.

Turning next to FIG. 16, there is seen a folding reclining theater chair comprising a seat 430 and a chair back 450 both tiltably carried on a base 470 which is bolted to a transverse box beam 490. Commonly, a plurality of such chairs will be emplaced on beam 490 at regularly spaced intervals.

Figure 20:
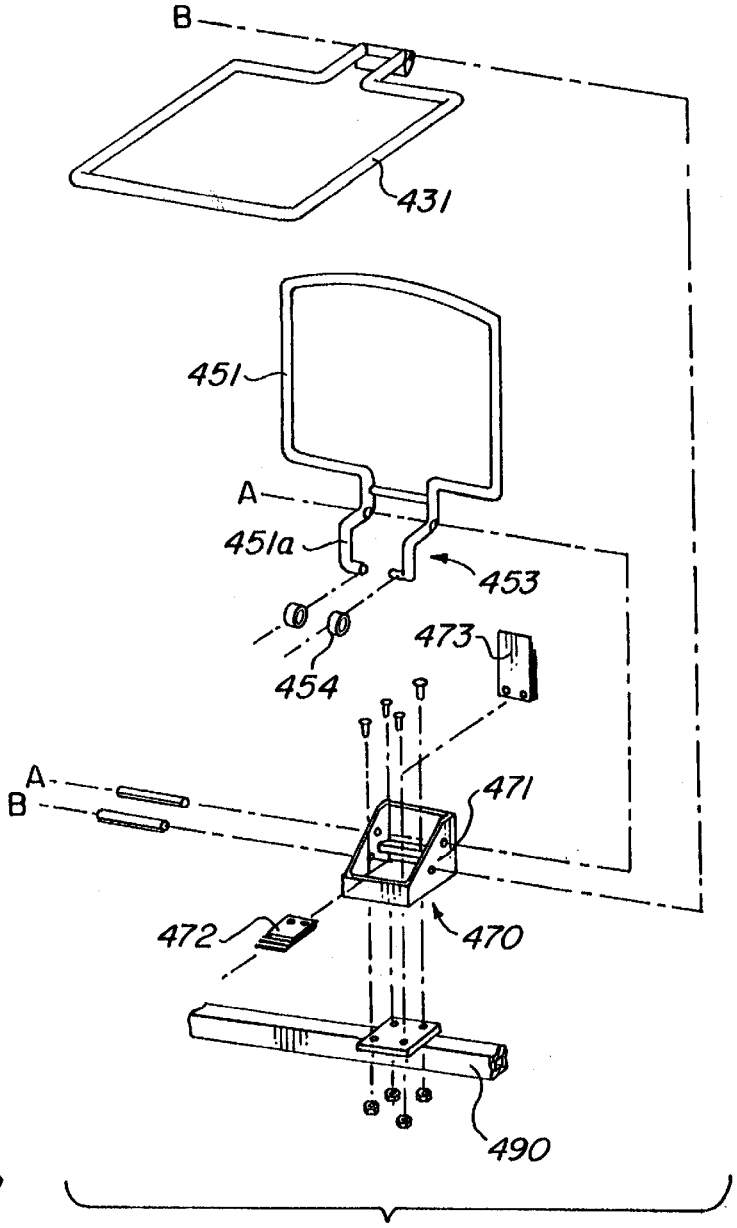
FIG. 20 is an exploded view of the chair of FIGS. 16–19.

As best seen in FIG. 20, base 470 is an open, box-like structure having parallel trapezoidal sidewalls 471 rotatably supporting an upper, rearward axle A, to which is fixed a chair back frame 451, and a lower, forward axle B, to which is fixed a seat frame 431.

Figure 19:
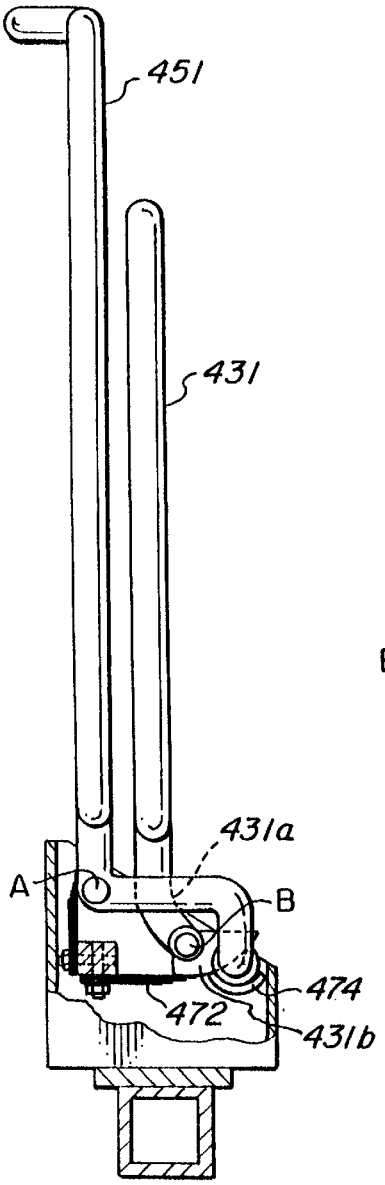
FIG. 19 is a side view, partly broken away, of the chair of FIG. 16 in the folded position.

Seat frame 431 which supports a seat cushion (not shown) is generally rectangular and has an outwardly and downwardly curving connecting portion 431*a* attached to axle B. A rearwardly facing curved cam 431*b* on connecting portion 431*a* cooperates with a first leaf spring 472 on base 470 to bias seat 430 to the vertical folded position illustrated in FIG. 19.

Chair back frame 451 which supports a chair back cushion (not shown) is generally rectangular and includes projecting portions 451*a* comprising a lever 453. Both seat frame 431 and chair back frame 451 are formed from ¾ inch diameter steel tube. Rotatable plastic bushings 454, disposed on the ends of projecting portions 451*a*, engage the curved bottom surface of seat frame connecting portion 431*a*. A second leaf spring 473 on base 470 biases chair back 450 to its unreclined position. A trough-shaped stop member 474 on base 470 abuts bushings 454 to prevent chair back frame 451 from tilting forwardly beyond the unreclined position.

As an occupant of the chair leans back, chair back 450 tilts rearwardly, pivoting on axle A, and lever 453 presses upwardly on seat frame connecting portion 431*a* causing it to tilt. As chair back 450 is tilted further and further, bushings 454 advance along connecting portion 431*a* away from axle B on which seat 430 pivots, thereby reducing the force needed to further recline the chair.

Figure 21:
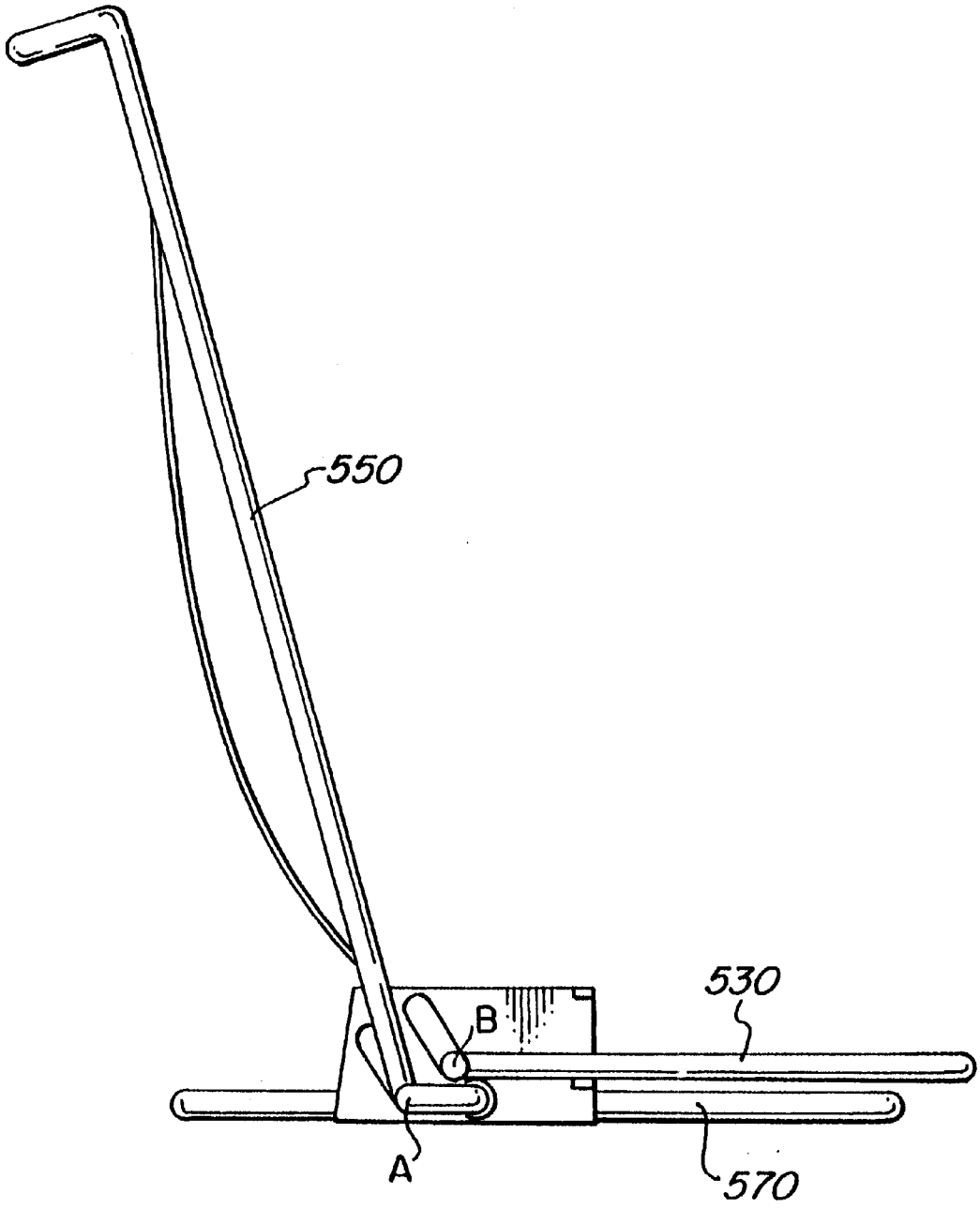
FIG. 21 is a side view of a folding, reclining beach chair in accord with the present invention, in the unfolded and upright position.
Figure 23:
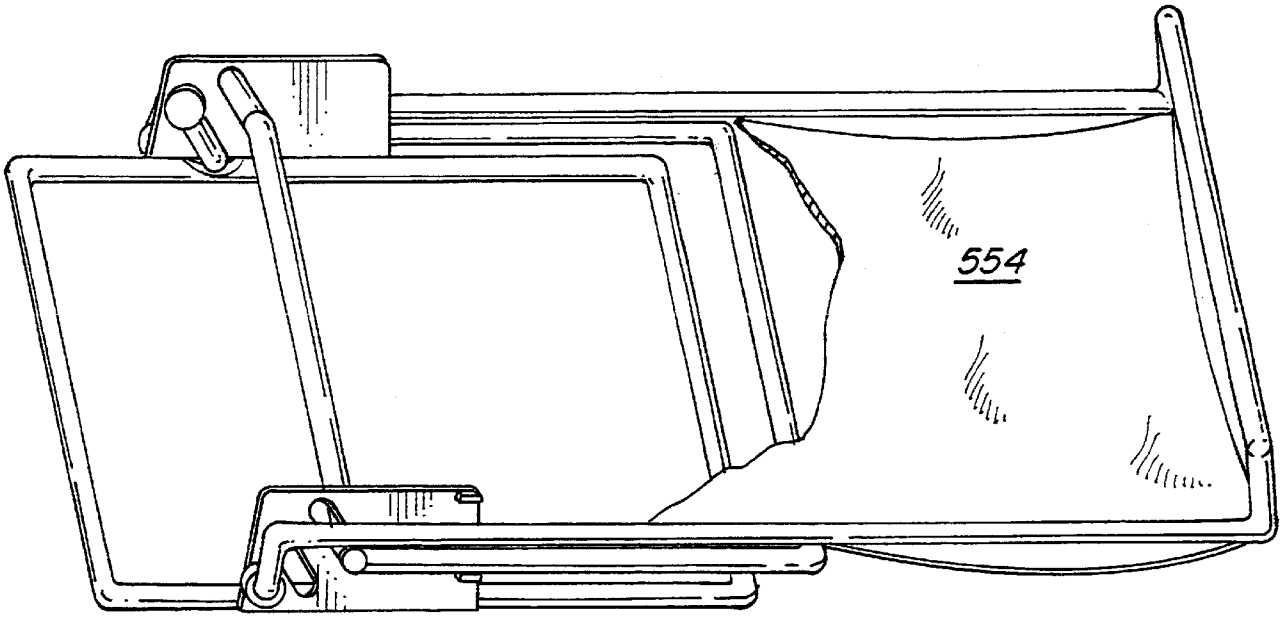
FIG. 23 is an isometric view, with the seat and chair back fabric partly removed, of the chair of FIGS. 21 and 22 in the folded position.
Figure 22:
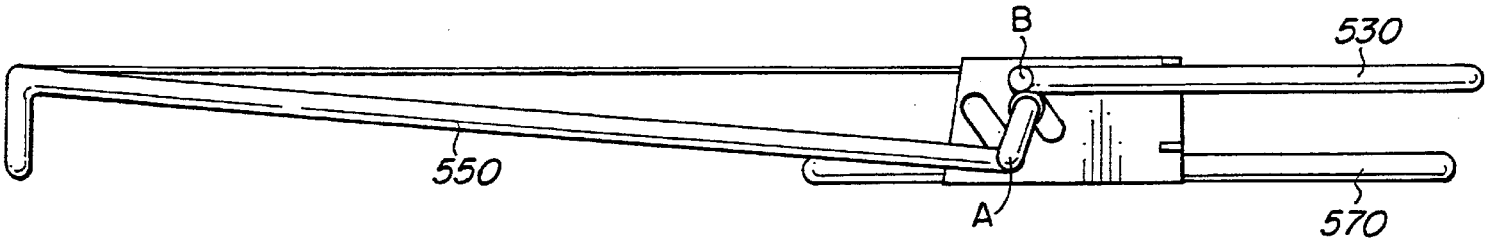
FIG. 22 is a side view of the chair of FIG. 21 in the reclined position.

Turning last to FIG. 21, there is seen a folding reclining beach chair including a seat frame 530 and a chair back frame 550 both tiltably carried on a base 570. Seat frame 530, chair back frame 550 and base 570 all are formed from hollow aluminum tube.

Figure 24:
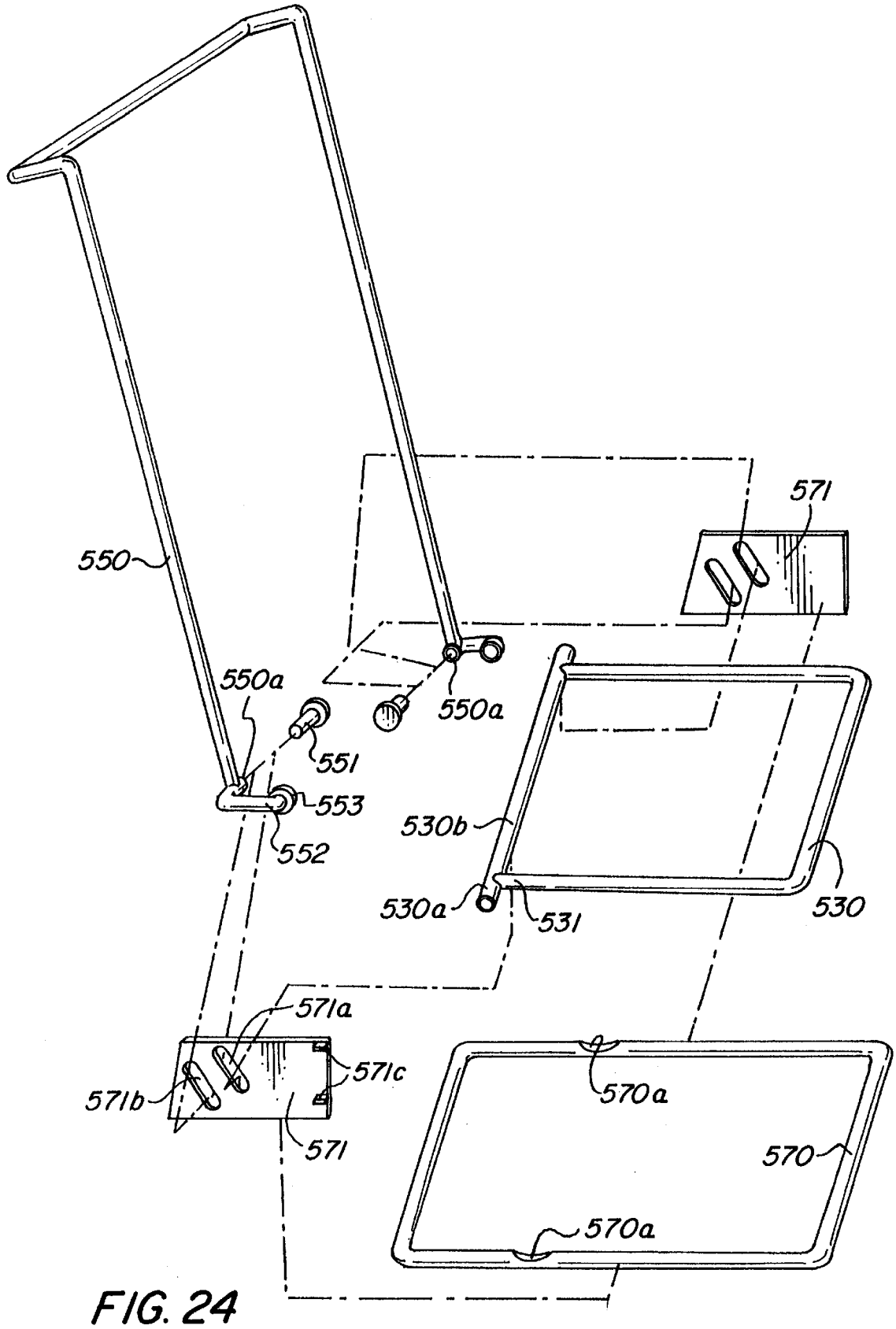
FIG. 24 is an exploded view of the chair of FIGS. 21–23.

As best seen in FIG. 24, base 570 is rectangular in shape. Upstanding planar cam plates 571 are welded to the outside of base 570 in opposed relation, rearward of the midpoints of the longer sides. Cam plates 571 are each formed with a pair of generally parallel, rearwardly inclined slots 571*a* and 571*b*.

Seat frame 530 is generally rectangular, with projecting axle portions 530*a*, which are the distal portions of seat rear frame member 530*b*, passing through forward slots 571*a* in cam plates 571. Seat frame end closures 531 rotatably retain seat frame 530 in cam plates 571.

Chair back frame 550 is generally U-shaped, with projecting axle portions 550*a* which pass through rearward slots 571*b*. Chair back frame 550 is rotatably retained in cam plates 571 by chair back frame end closures 551. Projecting from axle portions 550*a* at substantially right angles to chair back frame 550 are levers 552 having rotatable bushings 553 disposed at their ends. Slots 571*a* serve two functions. During reclining of the chair, slots 571*a* provide clearances between seat frame 530*b* and bushings 553 on levers 552. This makes possible the extreme degree of recline of chair back while seat remains substantially horizontal. Slots 571*a* also contribute to the generation of the force needed to return the chair to its upright position of utilizing the leverage of back frame 550 against levers 552 and bushings 553 to force seat frame 530*b* to travel upward in the slots. When a reclining user sits upright again, his weight shifts off back frame 550 providing an increasing downward force on seat frame 530*b* to bring the chair upright.

A canvas chair back 554 is loosely stretched from the top of chair back frame 550 to the seat rear frame member 530*b* and then to the front bar of seat frame 530.

When the chair is in its unfolded position, bushings 553 contact the bottom surface of seat frame 530. Tilting of the chair is accomplished in the same way as in the previously described embodiments. Abutments 571*c* on cam plates 571 comprise full reclined and full upright travel stops for seat frame 530. Clearance recesses 570*a* in base 570 allow the chair to reach the full upright position.

While the present invention has been described with reference to the presently preferred embodiments, it will be understood by those skilled in the art that variations may be made thereto without departing from the spirit of the invention which is limited in scope only by the appended claims.

Having thus described the invention, what is claimed is:

1. A reclining chair comprising:

(a) a base;

(b) a seat mounted on said base pivotally supporting said seat for tilting movement about a first horizontally extending pivot means between a first substantially horizontal position and a second reclined position;

(c) a chair back;

(d) second horizontally extending pivot means supported on said base pivotably supporting said chair back for tilting movement between a first substantially vertical position and a second reclined position, said second horizontal pivot means moving on said base in a generally vertical direction as said seat back is tilted and;

(e) lever means having one end engaged with said chair back and its other end engageable with said seat for tilting said seat about said first horizontally extending pivot means as said chair back is tilted, said lever means contacting said seat at a point which moves in response to the tilting of said chair back.

2. The chair of claim 1 wherein said seat includes a contact portion adapted for engagement with said lever means, said contact portion being configured to provide a predetermined displacement of said seat in response to displacement of said chair back.

3. The chair of claim 1 further comprising a spring element on said base acting against said seat and biasing said seat and said chair back to said first position.

4. The chair of claim 3 further comprising means for adjusting the spring force of said first spring means.

5. The chair of claim 1 further comprising a rotatable bushing on said lever means at the point of contact with said seat.

6. The chair of claim 1 further comprising a pedestal, said base being supported on said pedestal.

7. The chair of claim 1 further comprising spring means on said base biasing said second horizontal pivot means of said chair back to a position in which said seat and said chair back are in said first position.

8. The chair of claim 1 wherein said seat and said chair back are tiltable to a third, forwardly inclined, position.

* * * * *